US006478407B2

(12) United States Patent
Muramatsu et al.

(10) Patent No.: US 6,478,407 B2
(45) Date of Patent: Nov. 12, 2002

(54) RECORDING HEAD AND IMAGE RECORDING APPARATUS UTILIZING SAID RECORDING HEAD

(75) Inventors: Hiroyuki Muramatsu, Chiba (JP); Seiji Kuwabara, Chiba (JP); Tatsuro Sato, Chiba (JP); Kouji Kawaguchi, Chiba (JP); Shunichi Tanaka, Chiba (JP); Tokuya Akase, Chiba (JP)

(73) Assignee: Seiko Instruments Inc. (JP)

( * ) Notice: Subject to any disclaimer, the term of this patent is extended or adjusted under 35 U.S.C. 154(b) by 34 days.

(21) Appl. No.: 09/819,480

(22) Filed: Mar. 28, 2001

(65) Prior Publication Data

US 2002/0030719 A1 Mar. 14, 2002

(30) Foreign Application Priority Data

| | | |
|---|---|---|
| Apr. 3, 2000 | (JP) | 2000-101390 |
| Jan. 11, 2001 | (JP) | 2001-004056 |
| Mar. 22, 2001 | (JP) | 2001-082213 |

(51) Int. Cl.[7] ..... B41J 2/04

(52) U.S. Cl. ..... 347/55

(58) Field of Search ..... 347/55, 151, 120, 347/141, 159, 103, 123, 111, 127, 128, 131, 125, 158; 399/271, 290, 292, 293, 294, 295

*Primary Examiner*—Raquel Yvette Gordon
(74) *Attorney, Agent, or Firm*—Adams & Wilks

(57) ABSTRACT

There is provided a recording apparatus capable of outputting an image which is not provided with nonuniformity of printing, stable and provided with high quality by realizing a recording head for maintaining a shape of a meniscus of ink always in a proper state without carrying out highly accurate back pressure control. Hence, a shape of front ends of base plates forming a slit-like opening portion is constituted by a shape of a wedge directing a sharpened front portion thereof to a recorded medium. Further, an inclined face portion in the shape of the wedge is subjected to a water repellant or an oil repellant processing. Or, there is constructed a constitution of providing an ink discharge mechanism for discharging extra ink at an end face portion at outside of a printing area of the base plate constituting the slit-like opening portion.

29 Claims, 10 Drawing Sheets

RECORDING HEAD AND IMAGE RECORDING APPARATUS UTILIZING SAID RECORDING HEAD

BACKGROUND OF THE INVENTION

The present invention relates to a recording head of an ink jet recording system for providing, on record paper, an output image capable of corresponding to wide needs from the printing industry requesting high-speed output of high quality image, the printer industry based on office or personal request to civil product industry requesting general purpose output apparatus using a variety of kinds and a variety of use of record paper and having low price, and an image recording apparatus utilizing the recording head.

According to a conventional image recording apparatus, particularly, an apparatus using an ink jet system, recording operation is carried out such that droplets of ink are produced and made to fly by an ink jet recording head based on various ink delivering systems (for example, an ink jet recording head by a system of providing mechanical vibration or displacement to ink by using a piezoelectric element or an ink jet recording head by a system of heating to foam ink and utilizing pressure thereof) and portions or a total thereof are adhered onto a recorded medium such as paper. Therefore, in any of the ink jet recording heads, there is formed a nozzle communicating with a delivery port for delivering ink and a single record dot corresponds to a single piece of the nozzle.

Therefore, according to such a conventional image recording apparatus, since the single piece of nozzle of the ink jet recording head for carrying out recording operation by delivering and adhering ink droplets to a recorded medium, corresponds to the single record dot, very small nozzles must be formed over all the width of the ink jet recording head, not only very fine and difficult fabrication technology is needed but also cost of the ink jet recording head is increased and there poses a problem that owing to drying and solidifying ink and a nozzle structure having a small diameter, a jet port is liable to clog and recording operation becomes unstable.

Therefore, there has variously investigated a method of resolving the-problem particular to ink jet recording. Above all, attention is attracted to a slit jet recording system (disclosed in Japanese Patent Publication No.59669/1985) in which an opening portion having a slit-like shape is used and ink is sucked and made to fly from the opening portion by Coulomb's force since the opening portion is formed in the slit-like shape and therefore, ink is difficult to clog, further, highly integrated formation of the opening portion can be carried out.

Meanwhile, according to the slit jet recording system, since viscous resistance of an ink flow path is low, ink is liable to overflow by collapsing an ink meniscus, further, a shape of a recorded dot is controlled by the ink meniscus.

Therefore, in order to prevent ink hanging at a front end of a head in continuous printing, the front end of the head is subjected to a water repellant processing.

Maximum value p<max> of back pressure p capable of holding an opening portion in a slit-like shape in the slit jet recording system, is shown as follows by designating a height of a bottom face of a meniscus by notation a(m), surface tension of ink by notation T(N/m), back pressure of ink by notation p(mAq), a density of ink by notation ρ ($kg/m^3$) and the gravitational acceleration by notation g($m/sec^2$).

$$p<\text{max}>=2T/\rho ga \quad (1)$$

Therefore, when the back pressure p exceeds the maximum value, a force exerted to ink functions to balance with the back pressure and therefore, the ink bottom face a spreads by which the meniscus shape is expanded. As a result, an ink dot is enlarged and the resolution is lowered, or when ink overflows from the opening portion and the meniscus collapses, there is produced a nonuniformity of printing caused by occurrence of a failed dot or a dispersion in a dot size, which effects considerable influence on an output of printing.

Further, conversely, when the back pressure p is set to a value sufficiently smaller than the maximum value, an amount of expanding the meniscus is reduced, ink is difficult to fly and blur is liable to cause.

Therefore, in order to provide a stable printing output in the system, it is important to maintain the meniscus uniformly and in a state of being expanded as much as possible and for such purpose, it is necessary to always maintain the back pressure p in a state of being near to the maximum value as much as possible. When a dynamic range in the back pressure adjustment is set to be wide, stability of forming the meniscus is liable to ensure, which amounts to stability of the printing output.

However, in the case of the system of making ink fly by Coulomb's force as shown in the conventional example, an aqueous species ink having high surface tension cannot be used since voltage drop or electrolysis is caused in the ink jet recording head because the electrical conductivity of the aqueous species ink is high. Therefore, there is used an oil species ink having a low electrical conductivity, in that case, surface tension of the oil species ink is necessarily limited to be low from its physical property and accordingly, the maximum value of the back pressure p is set to be very small from Equation (1). Further, the opening portion of the ink jet recording head is constituted by a slit and therefore, loss by flow path resistance is very small. Therefore, back pressure is directly transmitted as it is and a sensitivity of a change in an amount of the meniscus relative to the back pressure value becomes very high.

When printing is carried out continuously in a state of high back pressure, the meniscus is liable to collapse in a printing area, as a result, overflowed ink may effect adverse influence on image quality.

From the above-described, there pose following problems in the conventional slit jet recording system.

(1) It is difficult to form a proper meniscus shape, as a result of incapable of forming the proper meniscus, the output becomes unstable and image quality is remarkably deteriorated.

(2) Although there is a method of controlling an amount of supplying ink by a small amount by carrying out back pressure control having particularly high accuracy, a control circuit therefor becomes complicated, or a pump having high accuracy is needed and cost of an apparatus therefor is increased.

(3) When the meniscus collapses in a printing area, there poses a problem that overflowed ink causes a failed dot and image quality is deteriorated.

SUMMARY OF THE INVENTION

Hence, it is an object of the invention to realize an ink jet recording head for maintaining a meniscus shape of ink always in a constant and proper state without using back pressure controlling means having particularly high accuracy and a recording apparatus capable of outputting an image which is not provided with nonuniformity of printing, is stable and is provided with high image quality thereby.

According to the ink jet recording head and the image recording apparatus using the recording head, front heads of base plates forming an opening portion are formed by a shape of a wedge constituting a shape projected to a recorded medium and critical surface tension at respective. inclined faces of the upper and lower base plates constituting the wedge shape, is made smaller than surface tension of ink. Thereby, a meniscus state of a shape of the meniscus formed to the opening portion is maintained constant. Further, in order to make the critical surface tension of the respective inclined face portions smaller than the surface tension of ink, the respective inclined face portions of the upper and lower base plates constituting the wedge shape, are subjected to an ink repellant processing. Further specifically, the inclined face portions in the wedge shape are subjected to a water repellant or an oil repellant processing in accordance with a material of ink.

Further, portions which are not subjected to the above-described ink repellant processing, for example, outer faces of the base plates communicating with the inclined face portion rearward from the inclined face portions relative to the recorded medium (hereinafter, referred to as head outer faces), are subjected to a hydrophilic processing when the ink is aqueous or a lipophilic processing when the ink is oily.

Or, in order to maintain a state of the meniscus formed at the opening portion constant, there is provided, at least one location, an ink discharging mechanism for discharging extra ink to portions of base plate end face portions constituting the opening portion other than a printing area.

Further, as the ink discharging mechanism, there is provided a notched groove having a size sufficiently larger than an inner width in a short direction of the opening portion at an end face of the base plate at a discharge position. By the constitution, extra ink leaks out to a surface of the base plate always by way of the notched groove portion firstly.

Further, there is constructed a constitution having detecting means for detecting a state of leaking out extra ink at the inclined face portion or the notched groove portion and back pressure controlling means for properly adjusting the back pressure (pressure of supplying ink to the ink jet recording head) in ink supplying means by the detecting means.

DESCRIPTION OF THE PREFERRED EMBODIMENT

A detailed explanation will be given of the invention in reference to the drawings as follows. Further, the invention is not limited by embodiments thereof.

Embodiment 1

An explanation will be given of an embodiment with regard to an ink jet recording head and an image recording apparatus according to the invention in reference to FIG. 1 and FIG. 2.

Figure 1:
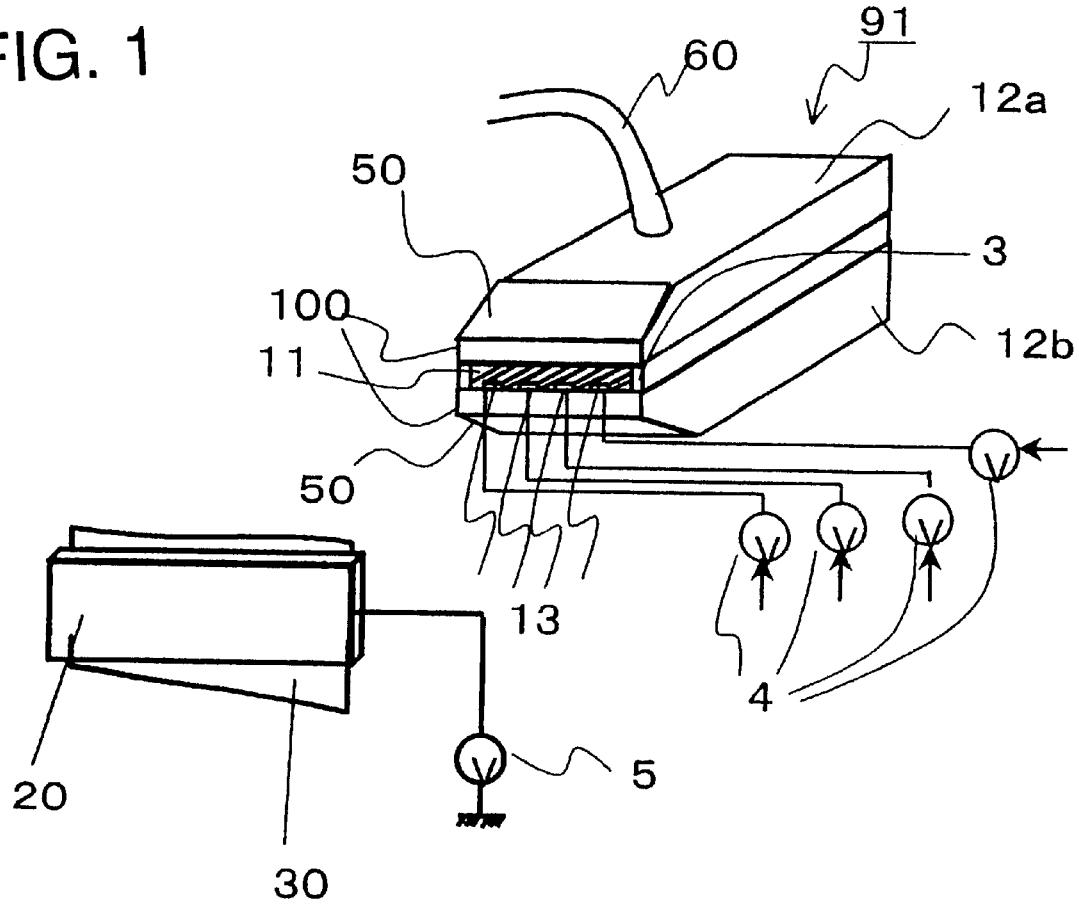
FIG. 1 is a perspective view of an image recording apparatus according to an embodiment of the inventions.

FIG. 1 is a perspective view showing an arrangement of an ink jet recording head 91, an opposed electrode 20 and record paper 30 of an image recording apparatus according to the embodiment of the invention. FIG. 2 is a side view of the arrangement of the ink jet recording head 91, the opposed electrode 20 and the record paper 30 of the image recording apparatus FIG. 1.

First, an explanation will be given of constituent elements of the image recording apparatus according to the embodiment. In FIG. 1, the head 91 is constituted by a head upper plate 12*a* and a head lower plate 12*b* and front end portions of the head upper plate 12*a* and the head lower plate 12*b* form an opening portion 11. Ink, not illustrated, is filled between the head upper plate 12*a* and the head lower plate 12*b*. Further, an ink supply path 60 is communicated between the head upper plate 12*a* and the head lower plate 12*b* and ink, not illustrated, is supplied to the opening portion 11.

Figure 2:
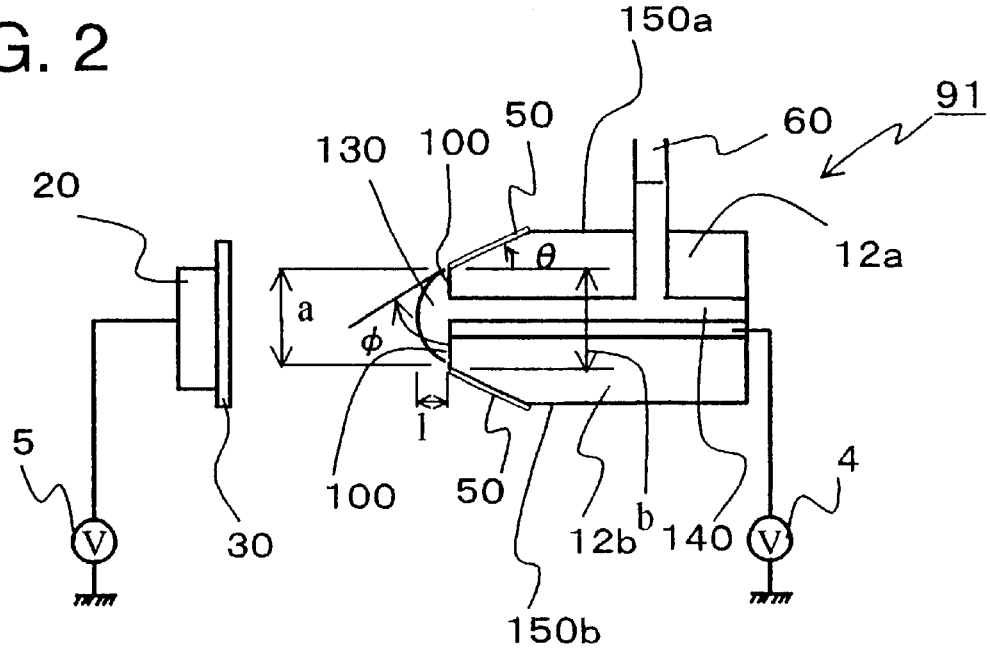
FIG. 2 is a sectional view of the image recording apparatus according to the embodiment of the invention.

According to the head 91 having the opening portion 11 in a slit-like shape as shown by FIG. 1, it is necessary to form a meniscus 130 as shown by FIG. 2 before printing in order to carry out injection of ink stably.

In order to control a meniscus width a and a meniscus height 1 of the meniscus 130 in FIG. 2 constant, there are provided inclined face portions 50 at a vicinity of the opening portion 11. The inclined face portions 50 are fabricated by polishing corner portions of the head upper plate 12*a* and the head lower plate 12*b*. An ink holding portion 100 is formed at the front end of the head 91 by the inclined face portions 50. The inclined face portions 50 are subjected to a water repellant and oil repellant processing such that ink is not stored at vicinities of the inclined face portions 50 by ink hanging. According to the embodiment, the water repellant and oil repellant processing is carried out by coating a fluorine species resin on the inclined face portions 50.

Although according to the embodiment, by facing the vicinity of the opening portion 11, the upper plate 12*a* and the lower plate 12*b* forming the opening portion 11, are formed in the shape of a wedge directing sharpened front portions thereof toward the opposed electrode 20, the head upper plate 12*a* and head lower plate 12*b* can be formed to constitute the wedge shape by injection molding.

According to the embodiment, glass having a thickness of 0.5 mm is used for the head upper plate 12*a* and the head lower plate 12*b* and an ink holding height b is made to be about 0.18 mm.

When a long direction of the opening portion 11 is defined as a main scanning direction and a short direction of the opening portion 11 is defined as a sub scanning direction, a plurality of record electrodes 13 are arranged above the head lower plate 12*b* in the main scanning direction at constant intervals. Further, spacers 3 for ensuring the height of the opening portion 11 are provided above the head lower plate 12*b* and the upper plate 12*a* is formed above the spacers 3 to thereby form the opening portion 11.

The plurality of record electrodes 13 are electrically bonded to power sources 4 and voltage in correspondence with a pixel signal can be respectively selected and applied to the plurality of record electrodes 13 by controlling means, not illustrated.

Further, the opposed electrode 20 is arranged with an interval of constant gap between the opposed electrode 20 and the opening portion 11 and the record paper 30 is arranged between the opposed electrode 20 and the opening portion 11 by a paper transfer system, not illustrated. The gap is pertinent to be 0.3 mm through 1 mm. The opposed electrode 20 is connected to a power source 5 and can be applied with voltage having potential and polarity different from those of the record electrodes 13. The record paper 30 may be ordinary paper or nonpaper material such as OHP can be used therefor.

It is preferable to use glass or Si for the head upper plate 12*a* and the head lower plate 12*b* in order to accurately fabricate a shape of the opening portion. Further, insulating performance is needed therefor since it is necessary to form an electric field for injecting ink. Therefore, according to the embodiment, glass (volume resistance value: 1.0×10E15 Ω·Cm) is used.

Patterning of the record electrodes 13 is fabricated by depositing aluminum onto a substrate by vacuum deposition and thereafter subjecting an aluminum thin film thereby to a chemical etching processing. A number of the record electrodes 13 is not particularly restricted and is controlled by a function of a switching driver IC. Further, although a pitch of the record electrodes 13 is pertinent to be 50 through 150 m, in this case, the record electrodes 13 are fabricated at a pitch of 140 $\mu$m.

Although according to the embodiment, aluminum is used as material of the record electrodes 13, the material is not particularly limited thereto but a metal material of copper, chromium, gold or nickel may naturally be used.

Further, so far as a face of the opposed electrode 20 is in parallel with the opening portion 11, other shape thereof is not particularly restricted. Although in this case, the opposed electrode 20 is fabricated by stainless steel which is difficult to corrode and difficult to be impaired, a metal material of aluminum or copper may be used.

Next, a description will be given of conditions of ink used for the invention as follows.

As factors of physical properties of ink significantly contributing to making ink fly, there are pointed out surface tension, viscosity and conductivity.

With regard to surface tension, the smaller the value, the smaller the resistance force in an ink delivery procedure and ink can be delivered even in a weak electric field.

Generally, surface tension is high in the case of aqueous ink and is 72.8 dyn/cm(20° C.) in the case of pure water, viscosity of an organic solvent is distributed in a range of about 20 through 35 dyn/cm and therefore, in this embodiment, there is used ink produced by dissolving a dye or dispersing a pigment in an organic solvent having low surface tension.

Viscosity of an ink solvent can be selected in a wide range and similar to surface tension, when viscosity is low, resistance force in the ink delivery procedure is small and ink can be delivered in a weak electric field, however, a solvent having low viscosity is provided with high volatility and accordingly, performance of preserving ink is poor and accordingly, actual viscosity range is preferably about 2.0 through 8.0 cP.

Further, for making ink fly, it is necessary to charge electric charge from the record electrodes at inside of the head portion to ink and accordingly, the volume resistance value of ink according to the invention is preferably equal to or larger than $1\times10^7$ (Ω·cm).

Further, with regard to set values of the properties of ink, whether ink can be made to fly, is dependent upon a value of voltage supplied between the opposed electrode 20 and the record electrodes 13, a distance between the opposed electrode 20 and the opening portion 11 and the shape of the opening portion 11 and therefore, ranges of properties such as optimal surface tension, viscosity and volume resistance value are not naturally limited to the above-described values necessarily.

A description will be given of operation of the image recording apparatus according to the embodiment as follows.

Voltages applied to the record electrodes 13 and the opposed electrode 20 are controlled in accordance with an image signal by a switching circuit, not illustrated. By potential difference between the opposed electrode 20 and the record electrodes 13, an electric field is generated between the opposed electrode 20 and the record electrodes 13 and Coulomb's force is produced in ink by the electric field. Ink is jetted from the opening portion 11 to the opposed electrode 20 by the Coulomb's force at a vicinity of a selected one of the record electrodes.

Thereby, dot-like recording is carried out at the record paper 30. The head 91 has finished printing one line and thereafter, the record paper 30 is moved in the sub scanning direction by a predetermined amount by a paper feed mechanism, not illustrated, and the above-described operation is repeated to thereby form a record picture. Further, it is also possible to prepare a plurality of the ink jet recording heads 91 as shown by FIG. 1, jetting inks having different colors by independently controlling the respective heads and printing to overlap a plurality of dots respectively having different colors to thereby illustrate a color image on the record paper 30.

Figure 3:
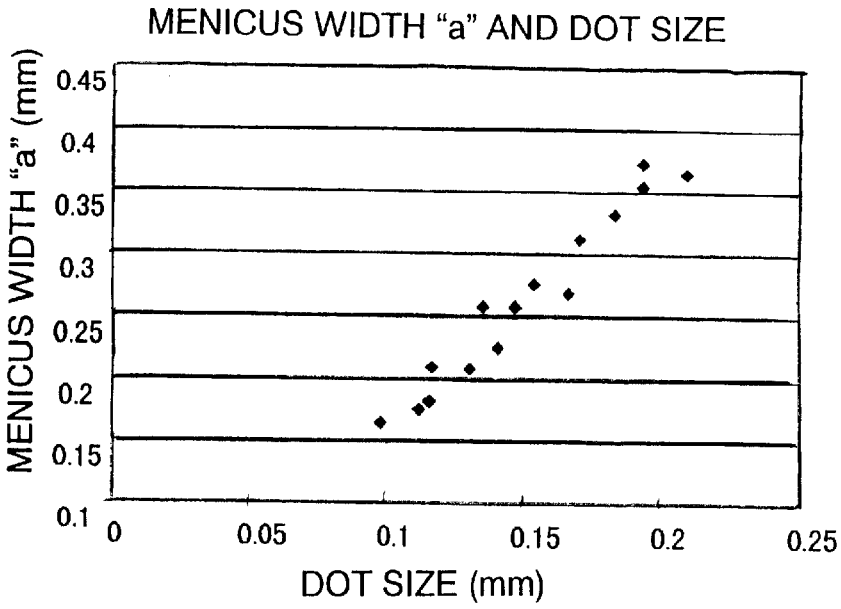
FIG. 3 is an explanatory diagram concerning a correlation between a dot size and a meniscus width.

An explanation will be given of a method of forming the meniscus and a method of discharging unnecessary ink according to the embodiment in reference to FIG. 2 and FIG. 3. FIG. 3 is an explanatory view showing a relationship between the meniscus width a and a print dot size.

First, an explanation will be given of the meniscus 130 and the print dot size.

The meniscus width a of the meniscus 130 of FIG. 2 is determined by the ink holding width b of the front end of the head 91 and the larger the ink holding height b, the larger the meniscus width a. When other printing condition remains to be the same, the larger the meniscus width a, the larger the diameter of a printed dot.

In the case of the embodiment, when voltage applied to the record electrodes 13 is set to −500V, voltage applied to the opposed electrode 20 is set to +2700V and an interval between the head and the opposed electrode 20 is set to 0.8 mm, as shown by FIG. 3, there is a clear correlation between the meniscus width a and the print dot size.

Next, an explanation will be given of methods of forming the meniscus and discharging unnecessary ink.

When in the ink holding portion 100 of FIG. 2, a contact angle ϕ between the ink holding portion 100 and ink becomes equal to or larger than a value which is determined by the material of the ink holding portion 100 and the physical property of ink, the surface tension collapses and unnecessary ink overflows from the ink holding portion 100 and ink flows to the inclined face portion 50.

When the inclined face portions 50 are subjected to a water repellant and oil repellant processing and critical surface tension of the inclined face portions 50 is made smaller than the surface tension of ink (ink repelling processing), the overflowed ink is liable to separate from the meniscus 130 and flow to an upper face 150*a* of the head upper plate 12*a* and a lower face 150*b* of the head lower plate 12*b* and ink which is unnecessary for the meniscus 130, can be prevented from being stored at vicinities of the ink holding portion 100 and the inclined face portions 50.

Thereby, even when printing is carried out continuously, unnecessary ink is difficult to be stored at vicinities of the ink holding portions 100 and inclined face portions 50 and the shape of the meniscus 130 is maintained constant. Therefore, printing can be carried out stably with a constant dot size.

Further, when angle θ at the front end of the inclined face portion 50 is equal to or larger than 45°, ink which is unnecessary for forming the meniscus 130, is liable to be stored at the vicinity of the inclined face portion 50 and sufficient effect cannot be achieved. However, when the angle θ is made to be equal to or smaller than 20°, ink which is unnecessary for the meniscus 130 is liable to flow from the inclined face portions 50 to the upper face 150*a* of the head upper plate 12*a* and the lower face 150*b* of the head lower plate 12*b* and the meniscus 130 can be formed stably.

Further, when the ink holding portions 100 are subjected to the water repellant and oil repellant processing, even ink which is necessary for forming the meniscus 130, flows from the ink holding portions 100 to the upper face 150*a* of the head upper plate 12*a* and the lower face 150*b* of the head lower plate 12*b*, the meniscus 130 cannot be formed by a predetermined amount and the dot cannot be printed stably. Therefore, it is not preferable to subject the ink holding portions 100 to the water repellant and oil repellant processing. Further, the ink holding portions 100 can be subjected to a hydrophilic-lipophilic processing in order to facilitate to effectively form the meniscus 130. Further, although according to the embodiment, there is constructed a structure in which the record electrodes 13 are not partitioned by walls at inside of the opening portion 11, similar effect can be expected when the opening portion 11 is constructed by a structure in which the opening portion 11 is partitioned by walls for the respective record electrodes 13.

Embodiment 2

An explanation will be given of an embodiment of an image recording apparatus according to the invention in reference to FIG. 2 and FIG. 4.

Figure 4:
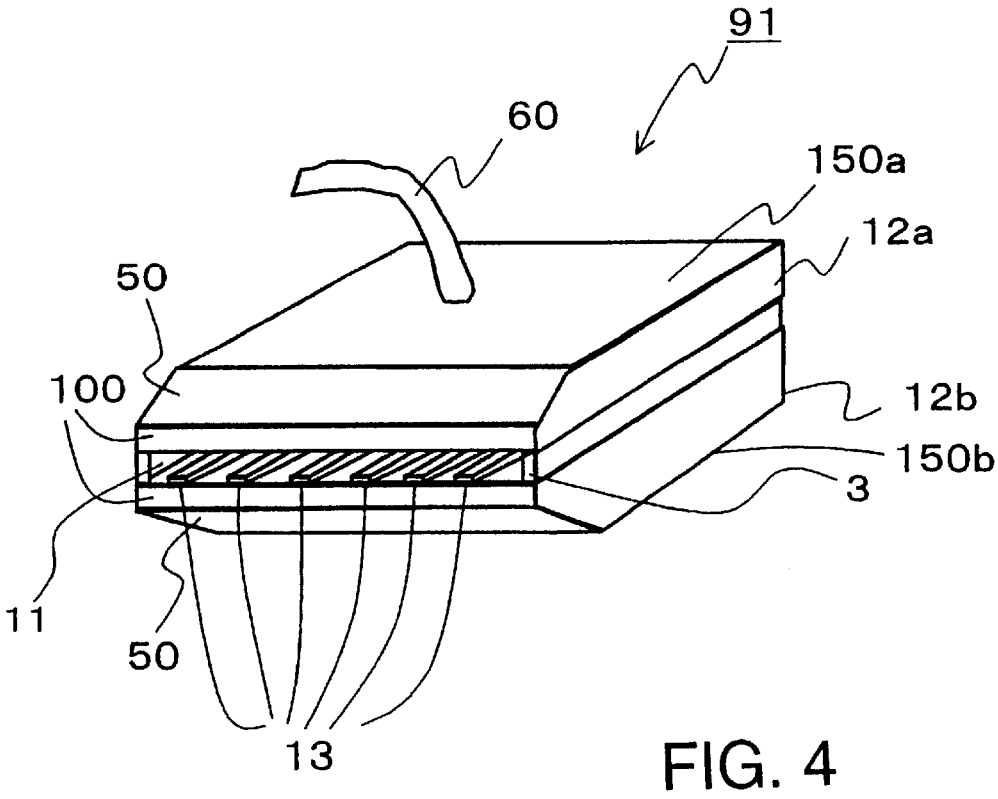
FIG. 4 is a perspective view of an ink jet recording head according to an embodiment of the invention.

FIG. 4 is an explanatory view showing the ink jet recording head 91 of the image recording apparatus according to the embodiment and illustration of an opposed electrode, record paper and a power source will be omitted. In FIG. 4, the upper face 150*a* of the head upper plate 12*a* is subjected to the hydrophilic-lipophilic processing. Other constitution is the same as that of embodiment 1.

The upper face 150*a* of the head upper plate 12*a* is subjected to the hydrophilic-lipophilic processing. When ink overflowed from the inclined face portion 50 flows to the upper face 150*a* of the head upper plate 12*a*, since the upper plate 150*a* is subjected to the hydrophilic-lipophilic processing, ink made to flow to the upper plate 150*a* is diffused over an entire face of the upper plate 150*a*. Therefore, ink is difficult to store at the inclined face portion 50 and the ink holding portion 100, unnecessary ink becomes easy to flow to the upper face 150*a* of the head upper plate 12*a* and accordingly, the meniscus 130 shown in FIG. 2 can stably be formed and an effect similar to that of Embodiment 1 can be achieved.

Although according to the embodiment, the upper face 150*a* of the head upper plate is subjected to hydrophilic-lipophilic processing, it is also possible to subject the lower face of the head lower plate 12*b* to the hydrophilic-lipophilic processing.

Further, even when the material per se of the substrate utilizes a member having the lipophilic performance, a similar effect is expected.

Embodiment 3

An explanation will be given of an embodiment of an image recording apparatus according to the invention in reference to FIG. 5.

Figure 5:
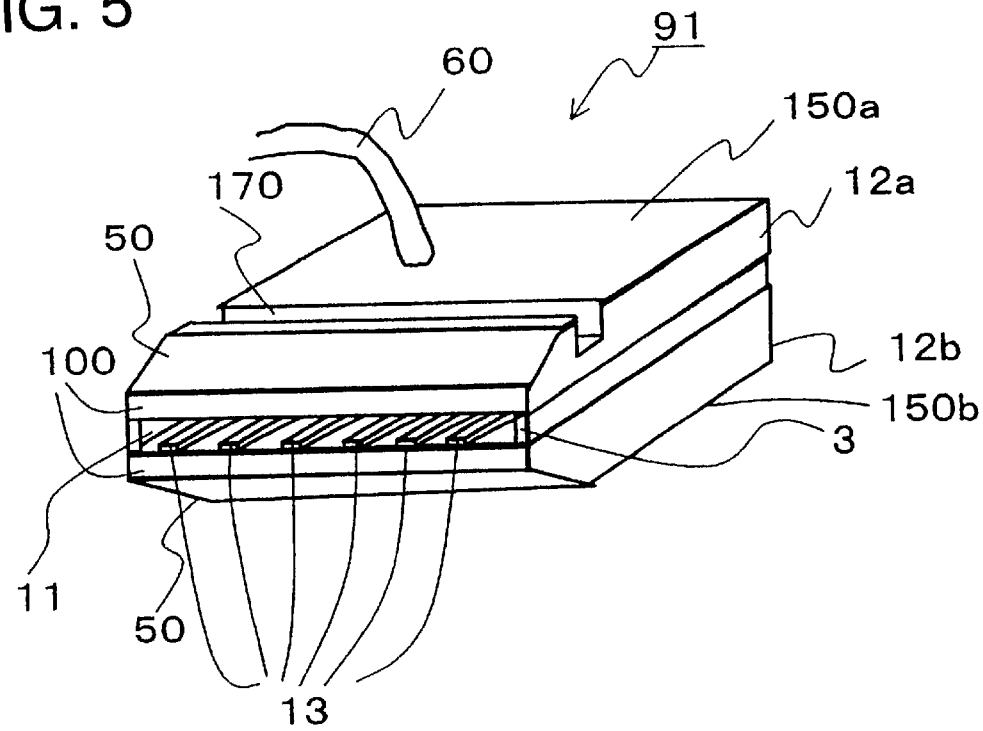
FIG. 5 is a perspective view of an ink jet recording head according to an embodiment of the invention.

FIG. 5 is an explanatory view showing the ink jet recording head 91 of the image recording apparatus according to the embodiment and illustration of an opposed electrode, record paper and a power source will be omitted. In FIG. 5, a groove 170 is provided at the head upper plate 12*a*. When ink overflowed from the inclined face portion 50 flows to the groove 170, ink is prevented from being distributed onto the head upper plate 12*a* and cleaning of the head 91 is facilitated. Other constitution is the same as that of Embodiment 1.

According to the embodiment, the groove 170 is formed by subjecting the head upper plate 12*a* to dicing. Ink made to flow to the groove 170 can be prevented from overflowing from the groove 170 by wiping the groove 170 after a predetermined printing time period. Further, although according to the embodiment, the groove 170 is provided only on the head upper plate 12*a*, the groove 170 can also be provided at the head lower plate 12*b*. In that case, it is necessary to install a hygroscopic member such as sponge at the groove 170 such that ink does not hang from the head 91. Further, although according to the embodiment, the groove 170 is fabricated by dicing, the groove 170 can be fabricated by other method. Further, although the groove 170 is provided at one location, a plurality thereof can also be provided.

Embodiment 4

An explanation will be given of an embodiment of the ink jet recording head 91 according to the invention in reference to FIG. 6.

Figure 6:
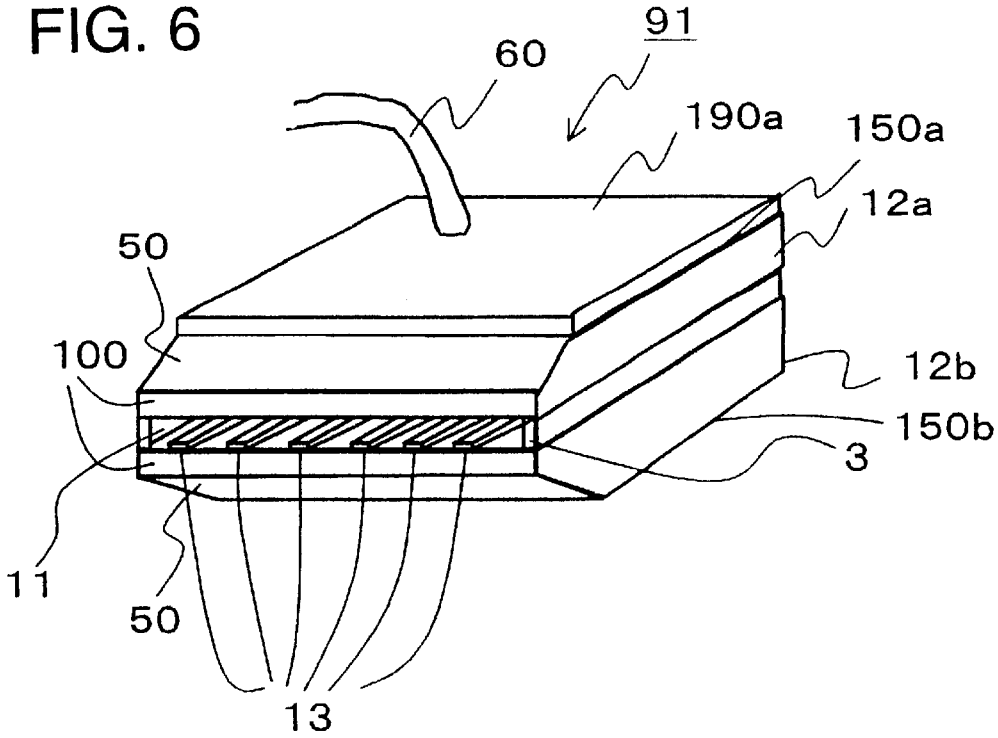
FIG. 6 is a perspective view of an ink jet recording head according to an embodiment of the invention.

FIG. 6 is an explanatory view showing the ink jet recording head 91 of an image recording apparatus according to the embodiment. Here, illustration of an opposed electrode, record paper and a power source will be omitted. In FIG. 6, a hygroscopic member 190*a* is attached onto the head upper plate 12*a*. Unnecessary ink overflowed from the inclined face portion 50 is absorbed by the hygroscopic member 190*a* and unnecessary ink can be prevented from adhering to a periphery of the head 91. By replacing the hygroscopic member 190*a* after a predetermined time period of printing, continuous printing can be carried out. Other constitution is the same as that of Embodiment 1.

Although in this case, sponge (47 mm×25 mm×thickness 5 mm) is used as the hygroscopic member 190*a*, no problem is particularly posed even with a hygroscopic member of other material.

Although according to the embodiment, the hygroscopic member 190*a* is attached only on the head upper plate 12*a*, the hygroscopic member 190*a* can also be attached to the head lower plate 12*b*. Further, although the hygroscopic member 190*a* is attached to an entire face of the upper plate 150*a* of the head upper plate 12*a*, even when the hygroscopic member 190*a* is attached to a portion of the upper face 150*a*, no problem is particularly posed when the portion is disposed at a vicinity of the inclined face portion 50.

Embodiment 5

Figure 7:
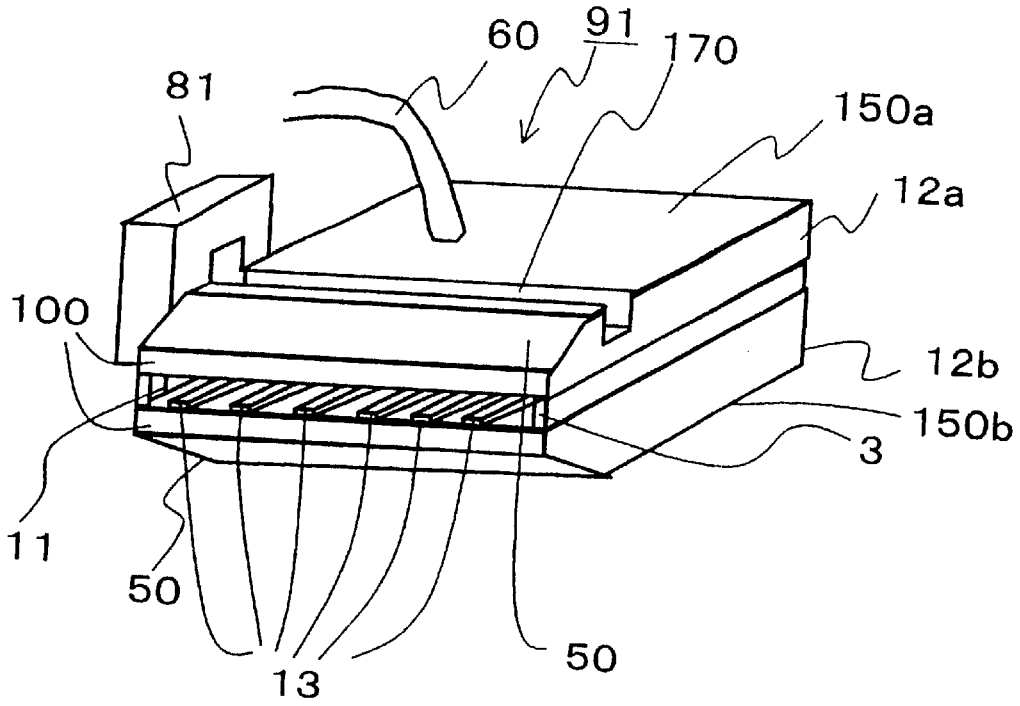
FIG. 7 is a perspective view of an ink jet recording head according to an embodiment of the invention.
Figure 8:
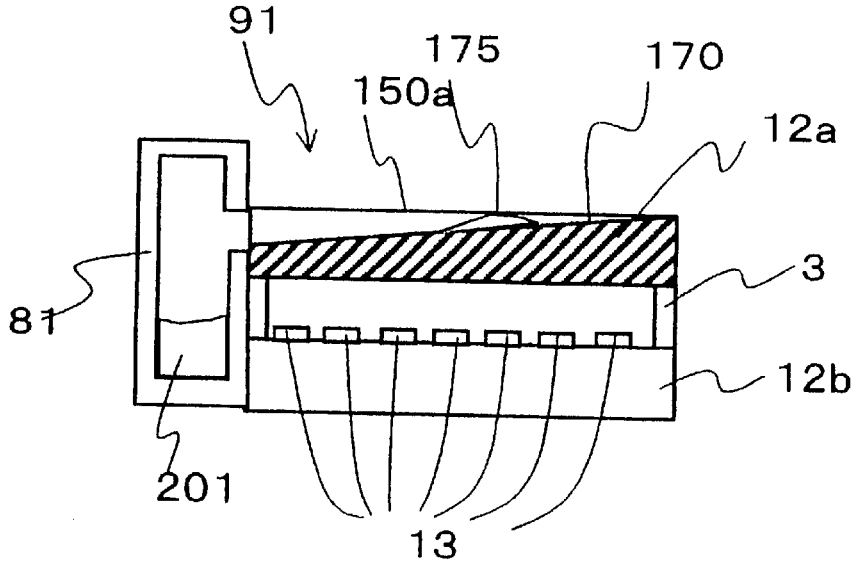
FIG. 8 is a sectional view of an ink jet recording head according to an embodiment of the invention.

An explanation will be given of an embodiment of the ink jet recording head 91 according to the invention in reference to FIG. 7 and FIG. 8. FIG. 7 is an explanatory view showing the ink jet recording head 91 of an image recording apparatus according to the embodiment and illustration of an opposed electrode, record paper and a power source will be omitted. FIG. 8 is a sectional view when the image recording apparatus of FIG. 7 is cut along the groove 170.

As shown by FIG. 7, the groove 170 is formed on the head upper plate 12*a*. Further, at a side face portion of the head 91, there is installed a waste ink tank 81. The groove 170 communicates with the waste ink tank 81.

As shown by FIG. 8, the groove 170 is formed such that a height thereof is lowered toward the waste ink tank 81 and ink 175 overflowed from the inclined face portion 50 is dropped to the groove 170 and is made to flow to the waste ink tank 81 by an inclination of the groove 170. Waste ink 201 is stored in the waste ink tank 81 and unnecessary ink can be utilized again by returning the waste ink 201 in the waste ink tank 81 to an ink tank, not illustrated, after a constant period of operation.

Thereby, unnecessary ink overflowed from the inclined face portion 50 can be recovered. Other constitution is the same as that of Embodiment 1.

Although according to the embodiment, the groove 170 is formed by dicing the head upper plate 12*a*, the groove 170 can be fabricated by other method.

Further, although according to embodiment, the groove 170 is used, as in Embodiment 4, it is also possible that a hygroscopic member is attached onto the head upper plate 12*a* and the hygroscopic member and the waste ink tank 81 are communicated with each other. Further, by subjecting the groove 170 to the water repellant and oil repellant processing, the above-described effect can be promoted.

Further, a recess portion may be provided at the substrate 12*a* or the substrate 12*b* to communicate with the groove without providing the waste ink tank.

Embodiment 6

An explanation will be given of an embodiment of an ink jet recording apparatus according to the invention in reference to FIG. 9.

Figure 9:
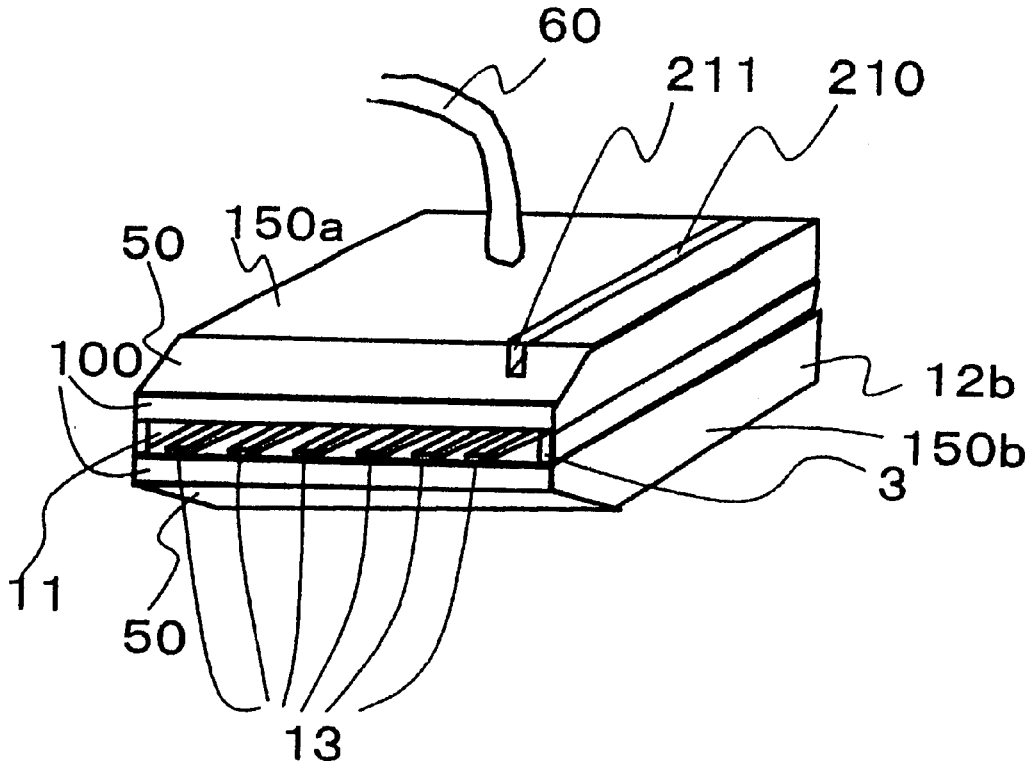
FIG. 9 is a perspective view of an ink jet recording head according to an embodiment of the invention.

FIG. 9 is an explanatory view showing the ink jet recording head 91 in the image recording apparatus according to the embodiment and illustration of an opposed electrode, record paper and a power source will be omitted. In FIG. 9, a groove 210 is formed to communicate with the inclined face portion 50. Other constitution is the same as that of Embodiment 1.

By communicating the groove 210 with the inclined face portion 50, unnecessary ink overflowed from the inclined face portion 50 becomes easier to flow to the groove 210 and unnecessary ink can be prevented from being adhered to a periphery of the head 91.

Further, by providing the groove 210 outside of a printing area (outside of a range of the record electrodes), the meniscus 130 of FIG. 2 can be adjusted without effecting influence on printing.

According to the embodiment, the groove 210 is formed by dicing. Although according to the embodiment, a single piece of the groove 210 is formed, a plurality of the grooves 210 can also be formed. The groove 210 can be subjected to the water repellant and oil repellant processing.

Embodiment 7

Figure 10A:
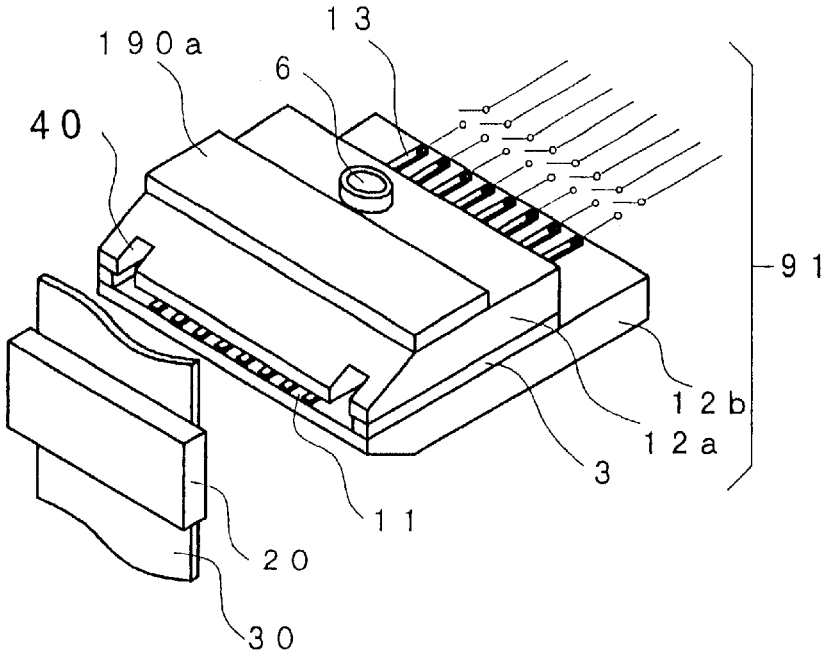
FIG. 10A is a perspective view showing an example of a constitution of an ink jet recording head according to the invention.
Figure 10B:
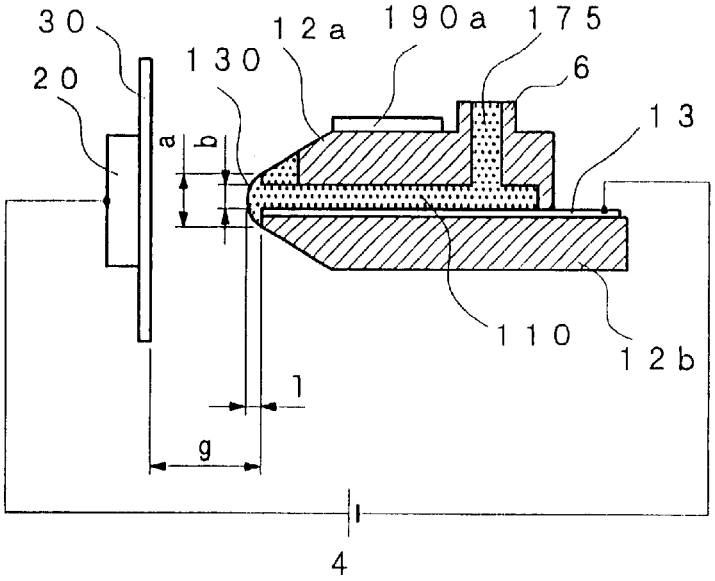
FIG. 10B is a side view showing the example of the constitution of the ink jet recording head according to the invention.

FIGS. 10A and 10B show an example of a constitution of an ink jet recording head according to the invention. FIG. 10A is a perspective view thereof and FIG. 10B is a side view thereof.

At both ends of an end face of the head upper plate 12*a*, there are provided notched grooves 40 which are discharging means for discharging extra ink and the both members are disposed at outside of a range of the record electrodes 13 in the opening portion 11, that is, on outer sides of an printing area. Further, the groove width of the notched groove 40 is set to be a width sufficiently larger than at least the ink holding height b to facilitate to distribute ink. Further, the opening portion 11 is formed up to at least areas of the notched grooves 40 and FIG. 10B shows a state in which ink 175 is filled. Further, there is provided a hygroscopic member 190*a* for absorbing extra ink as ink recovering means rearward from a faced portion of an outer face of the head upper plate 12*a*.

The opposed electrode 20 is provided on the side of the opening portion 11 of the ink jet recording head 91 constituted as described above via a very small gap g. The width of the opposed electrode 20 is substantially within an area of arranging the record electrodes 13 and the opposed electrode 20 is arranged such that the opposed electrode 20 is not opposed to the notched grooves 40. Further, in printing, the record paper 30 constituting a recorded medium is interposed in the gap by transferring means, not illustrated.

Further, in order to electrify ink and exert Coulomb's force as a principle of making ink fly, the record electrodes 13 are at least connected with the power sources 4 via a drive circuit and voltage pulses can be applied thereto. That is, when the voltage pulses are applied to the record electrodes 13 based on an input image signal, ink at the periphery of the record electrodes 13 is electrified and at the same time, by an electric field generated between the record electrodes 13 and the opposed electrode 20, the ink receives Coulomb's force and the ink is sucked and made to fly to the opposed electrode 20. Although the opposed electrode 20 may be grounded at this occasion, in order to avoid the side of the record electrodes 13 from being applied with load, voltage having a polarity inverse to that of the record electrodes 13 can be applied to the side of the opposed electrode 20 as bias.

An explanation will be given as follows of a change in a state of the meniscus by a variation in the back pressure at the ink jet recording head constituted as described above in reference to FIGS. 11A, 11B, 11C, 11D and 11E.

FIGS. 11A through 11E are side views showing a procedure of a change in the state of the meniscus at the ink jet recording head of the invention.

When ink 175 is filled in an ink tank, ink 175 communicates with the opening portion 11 by the static back pressure via a desired flow path and ink 175 is filled therein. Further, ink is spread to end face portions of the base plates forming the opening portion 11 and spread to edge line portions of the faced portion, that is, the width a as a limit value and forms the meniscus. An explanation will be given of operation when the back pressure exceeds a maximum value in reference to FIGS. 11A through 11E as follows.

Figure 11A:
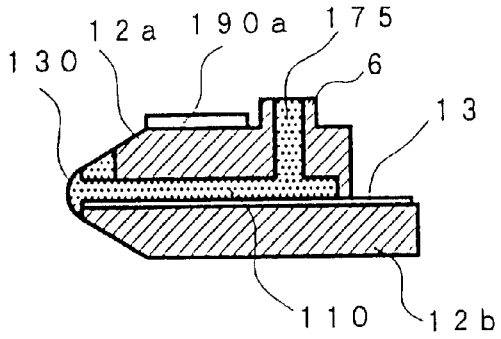
FIGS. 11A through 11E are side views showing a procedure of a change in a meniscus state of an ink jet recording head according to the invention.

FIG. 11A shows a state in which the back pressure is within a proper range yet. At this occasion, the meniscus 130 in a projected shape is stably formed at the opening portion 11.

Figure 11B:
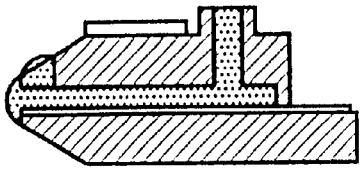

FIG. 11B shows an initial state at which the back pressure exceeds the maximum value. At this occasion, extra ink 175 stored at the opening portion 11, immediately flows to portions of the notched grooves 40 having low flow resistance, ink 175 is filled in the portions of the notched grooves 40 and ink 175 at the portions starts growing in an upper direction. In this occasion, the meniscus in the printing area maintains a balance in a state of substantially a maximum value.

Figure 11C:
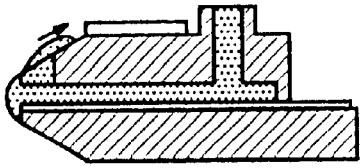

FIG. 11C shows a state in which the back pressure of ink continuously exceeds the maximum value. The ink 175 which has grown at the notched grooves 40, collapses at vicinities of end points of the notched grooves 40 prior to any other portion of the opening portion 1 and grows at the faced portion and one end thereof is moved toward a surface of the upper substrate (arrow mark direction) on the surface of the faced portion by widening a skirt thereof. At this occasion, since ink 175 overflowed from the portions of the notched grooves 40 is disposed rearward from the opening portion 11 and the notched grooves 40 are not opposed to the opposed electrode 20, almost no influence is effected on printing. Further, the meniscus in the printing area at this occasion maintains substantially in the state of the maximum value.

Figure 11D:
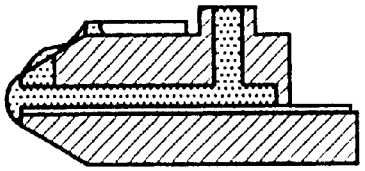

FIG. 11D shows a state in which the back pressure of ink 175 exceeds the maximum value further continuously. The one end of the ink 175 which has grown in the notched grooves 40, widens the skirt up to the surface of the head upper plate 12*a* and when the ink is brought into contact with the hygroscopic member 190*a* installed at the surface of the base plate, the hygroscopic member 190*a* rapidly absorbs to recover extra ink 175. Also at this occasion, the meniscus in the printing area maintains substantially the state of the maximum value.

Figure 11E:
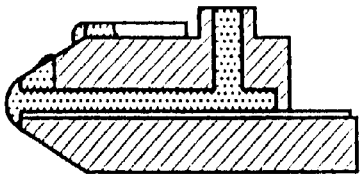

FIG. 11E shows a state in which extra ink 175 is absorbed and the back pressure becomes substantially equal to the maximum value of balance or smaller than the maximum value. At this occasion, the back pressure and the side of the meniscus are dynamically balanced and accordingly, ink at the notched grooves 40 stops growing and at the same time, ink 175 communicated from the notched grooves 40 to the hygroscopic member 190*a* is interrupted and the stable state of FIG. 11A is recovered again. Also at this occasion, the meniscus in the printing area substantially maintains the state of the maximum value.

By the above-described operation, even when the back pressure exceeds the maximum value, unnecessary pressure is escaped by discharging extra ink 175 by the notched grooves 40 and accordingly, the shape of the meniscus in the printing range of the opening portion 11 can be maintained always in the stable state.

Further, in the case of Embodiment 7, by subjecting paths between the notched grooves 40 and the outer face of the head upper plate 12*a* to the water repellant and oil repellant processing, in the operation of FIG. 11E, interruption of ink 175 between the notched grooves 40 and the hygroscopic member 190*a* when ink stops growing, is much improved, further, there is achieved an effect of promoting operational stability and high speed performance of the embodiment. Further, when a total of the faced portion is subjected to the water repellant and oil repellant processing, not only the above-described effect is achieved but also in the meniscus 130 of the printing area, the contact angle can be maintained to be high and therefore, the maximum value of the back pressure can be made high. That is, the dynamic range for adjusting the back pressure can be widened and accordingly, stability of forming the meniscus becomes high.

Figure 12A:
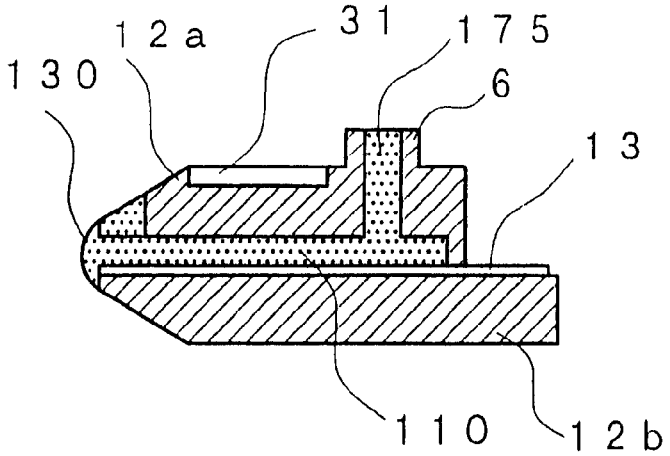
FIGS. 12A and 12B are side views showing other examples of ink recovering means according to the invention.
Figure 12B:
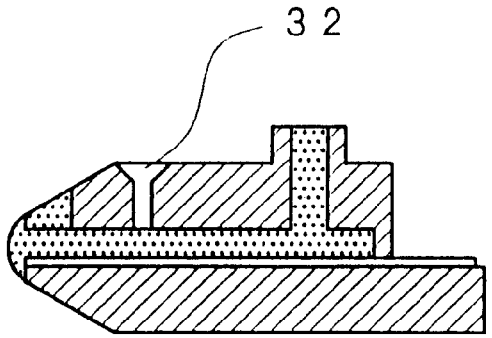

FIGS. 12A and 12B are side views showing other examples of ink recovering means according to the invention.

Although according to Embodiment 7, there is used a method of providing the hygroscopic member 190*a* as the ink recovering means, the invention is not limited thereto naturally but as shown by FIG. 12A, there may be provided a tray 31 or a tank for recovering ink 175. Further, as shown by FIG. 12B, there may be constructed a structure in which ink is communicated with a flow path at inside of the ink jet recording head 91 or an ink chamber 110 by perforating a hole at the head upper plate 12*a* and recovered ink 175 may be reused and by constructing the structure in this way, waste ink can be reduced and printing can be carried out efficiently.

Further, although according to Embodiment 7, the notched grooves 40 are provided at two locations of the upper base plate 7, the notched grooves 40 may be provided at any number of locations so far as the notched grooves 40 are disposed outside of the printing area, further, even when the notched grooves 40 are constituted on the side of the head lower plate 12*b* or side faces of the base plate, an equivalent effect is achieved.

Next, an explanation will be given of a method of dynamically controlling the back pressure by using a structure of an ink jet recording head according to the invention in reference to FIG. 13.

Figure 13:
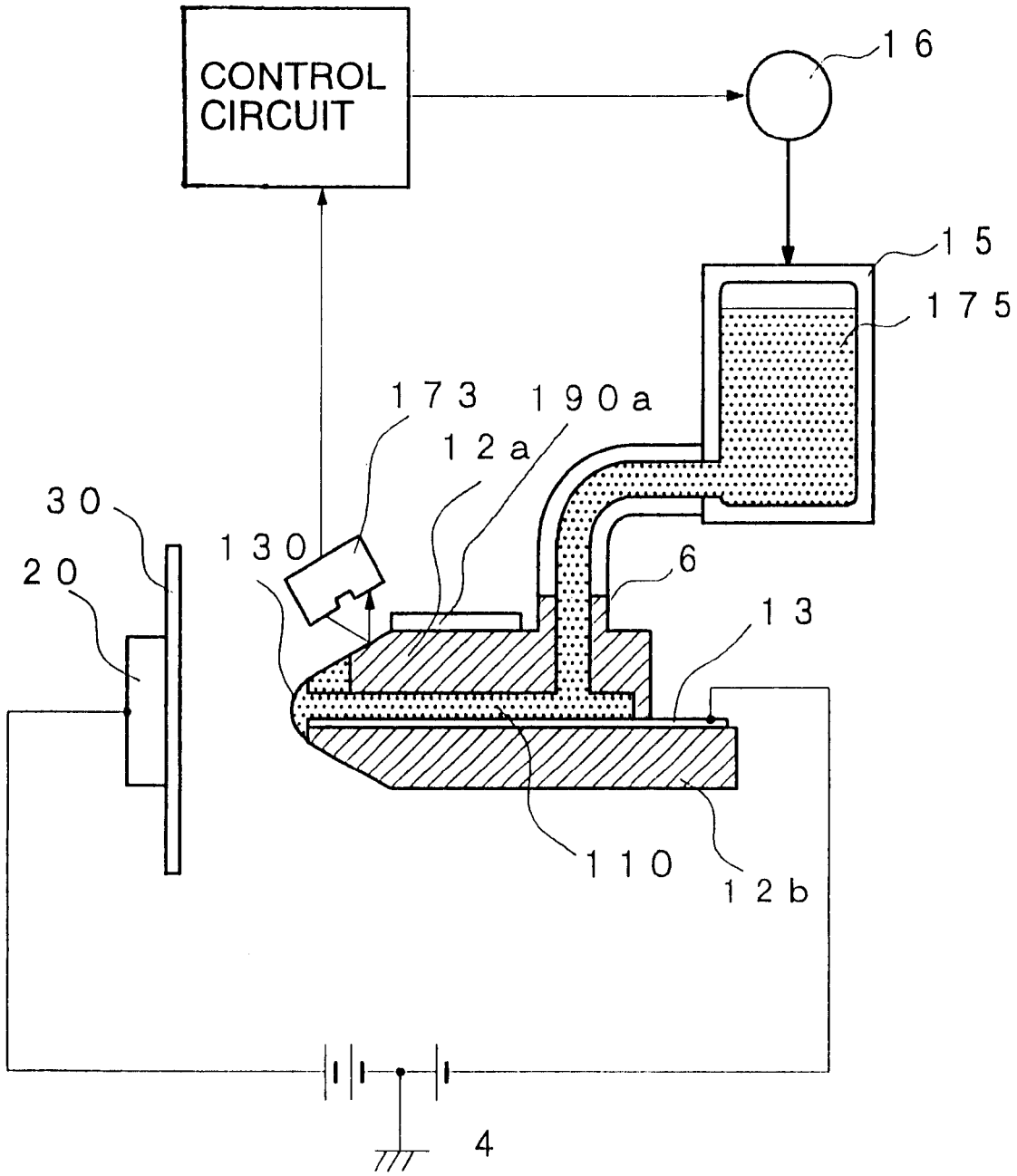
FIG. 13 is a side view showing a constitution of an ink jet recording head for dynamically controlling back pressure according to the invention.

FIG. 13 is a side view showing a constitution of an ink jet recording head for dynamically controlling the back pressure according to the invention.

There is used an ink jet recording head having a structure equivalent to that shown in Embodiment 7 and an electric type pump 16 is constituted at an ink tank 15 such that pressure can dynamically be applied to ink 175. Further, there is provided a reflection type photosensor 173 at a position of the notched groove 40 in the faced portion of the head upper plate 12*a* and the sensor 173 detects presence or absence of ink 175 in a path between the notched groove 40 and the head upper plate 12*a* and a detected result is fed back to operation of the pump 16.

According to the ink jet recording head having the above-described constitution, when the back pressure exceeds the maximum value, operation is carried out by the following procedure.

(1) Ink 175 overflows at the notched groove 40 and ink 175 communicates with the hygroscopic member 190*a* which is the ink recovering means.

(2) At the instance, the sensor 173 detects overflowed ink and the pump 16 is operated by the control circuit such that the back pressure is gradually lowered.

(3) When ink is not present in the path and ink stops overflowing, operation of the pump 16 is stopped by the control circuit.

By the above-described operation, the back pressure is dynamically controlled and the meniscus can be held substantially in a constant state.

Therefore, by constituting initializing operation by the above-described operation of the recording apparatus and replenishing a deficient amount of ink while controlling the back pressure by an amount of printing, in printing, the meniscus can be maintained always in a state near to the maximum value.

Further, the stable meniscus state can be ensured by constantly operating the pump 16 in printing after carrying out initializing operation as described above and continuing to replenish ink by a constant amount more or less larger than a necessary amount. Because even when the back pressure exceeds the maximum value, as in the above-described operation, the meniscus in the printing area can stably be maintained by discharging extra ink by the notched grooves 40 at outside of the printing area. Therefore, according to the invention, the stable meniscus state can be maintained easily by such a simple controlling method.

Next, an explanation will be given of an example of operation of the image recording apparatus in reference to FIG. 14.

Figure 14:
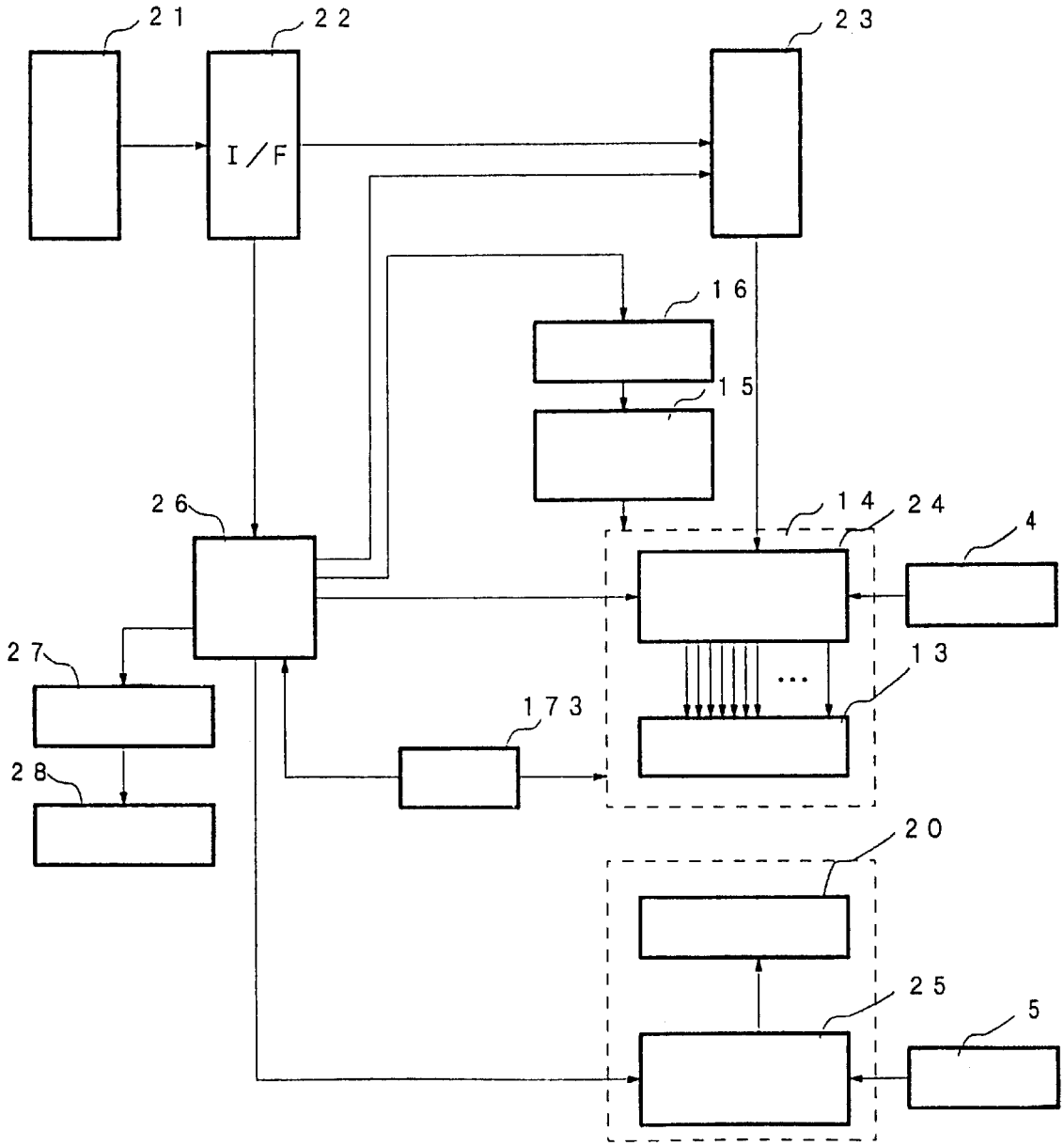
FIG. 14 is a block diagram showing recording operation of an image recording apparatus according to the invention.

FIG. 14 is a block diagram for showing recording operation according to the invention.

First, an explanation will be given of a structure of an ink jet recording head.

The ink jet recording head is equivalent to that shown in Embodiment 7, the record electrodes 13 in the ink jet recording head 91 are wired to the power sources 4 and the opposed electrode 20 is wired to the power source 5 having the polarity different from that of the record electrodes 13. Further, respective electrodes in the record electrodes 13 are connected to the power sources via drive circuits which can be driven independently from each other and desired voltage pulses can respectively be applied thereto in synchronism with a control signal from the control circuit 26 in the apparatus. The opposed electrode 20 can also be applied with desired voltage pulses in synchronism with the control signal from the control circuit.

Further, there is constructed a constitution in which the ink tank 15 is connected with the pump 16 for controlling the back pressure, the reflection type photosensor 173 is provided at the position of the path between the notched groove 40 and the hygroscopic member 190*a*, the sensor 173 detects presence or absence of ink in the path, that is, a state of leaking the ink 175 and the pump 16 is operated via the control circuit 26.

Now, an explanation will be given of operation of the image recording apparatus constituted in this way.

As shown by FIG. 14, first, a parallel signal outputted from an outside apparatus 21 such as PC terminal, is inputted to an interface 22 which is an outlet and an inlet of the recording apparatus and there is outputted a control signal constituted by a signal of start of printing, a parallel image data signal and a signal for controlling the apparatus from the interface 22.

When the signal of start of printing is received, first, there is carried out initializing operation for preparing for printing. At the recording head, there is carried out operation of a recovery system such as operation of removing a cap of the opening portion of the head portion and removing clog or cleaning operation from a service station. Thereafter, at the ink jet recording head, the pump 16 is operated and the back pressure is gradually applied to ink 175. At the opening portion 11, the meniscus 130 is gradually expanded and when the back pressure exceeds the maximum value, extra ink 175 is discharged from the notched grooves and ink 175 communicates with the hygroscopic member 190*a* on the head upper plate 12*a*. Then, the sensor 173 provided above the path detects leaking of ink since an amount of light at a light receiving portion is reduced and issues a signal to the control circuit 26 to thereby operate the pump 16 such that the back pressure is gradually lowered. When there is not ink 175 on the path, the light receiving amount of the sensor 173 ensures a constant value to thereby detect that ink has stopped leaking, operation of the pump 16 is stopped and the back pressure at the time point is maintained. Therefore, at this occasion, the meniscus 130 substantially ensures the maximum value and is maintained in a state optimum for making ink fly.

Thereafter, the record paper 30 which is the recorded medium is prepared. The record paper 30 is fed to inside of the apparatus by a paper supply system 27 such as ASF, and by a paper transfer system 28 frontward therefrom, a front end face of the record paper 30 is set to be opposed to the opening portion 11 of the ink jet recording head at a predetermined position.

In parallel with the above-described initializing operation, the parallel image data signal outputted from the interface 22 is inputted to a signal processing circuit 23. The control signal on one side outputted via the interface 22 is inputted to the control circuit 26.

Further, the signal processing circuit 23 receives the control signal outputted from the control circuit 26, converts the parallel image data signal outputted from the interface 22 into a serial binary signal and inputs the binary signal to a driver 24 for the record electrodes.

Further, in the record electrodes driver 24, a data signal is inputted and set to a built-in latch of a shift register type as information of a selected electrode (record electrode at a position of making ink fly) and a nonselected electrode (record electrode at a position of not making ink fly).

Further, at this occasion, the record electrodes driver 24 is constituted to apply the desired voltage pulse to the record electrode 13 when the control signal from the control circuit 26 is received. Similarly, a driver 25 for the opposed electrode is also constituted to apply the desired voltage pulse when the control signal from the control circuit 26 is received.

Further, after awaiting for a state in which all of data is set to the record electrodes driver 24, the control signal for driving the respective electrodes is outputted from the control circuit 26. The control signal is inputted to the record electrodes driver 24 and the opposed electrode driver 25, the desired voltage pulses are simultaneously applied to the selected electrode at inside of the record electrodes 13 and the opposed electrode 20 and at the same time, ink at the position of the selected electrode is made to fly and impacted to the record paper. 30 and printing of one line of the ink jet recording head is finished.

Next, the record paper 30 is fed in the sub scanning direction by the paper transfer system 28, there is brought about a state in which printing of a second line can be carried out, and according to the ink jet recording head, the pump 16 is operated during the time period, a predetermined amount of ink is filled in the opening portion 11 and there is brought about a state substantially the same as that of the first line. With regard to the amount of ink filled at this occasion, there is ensured an amount more or less larger than an amount of ink necessary for printing at least a total of the one line and the back pressure in correspondence therewith is applied for the respective line.

Therefore, when, for example, almost all of the one line of data is not printed, there is a possibility that the back pressure exceeds the maximum value, however, the proper meniscus state can be maintained similar to the first line by discharging extra ink from the notched grooves 4 provided at outside of the printing area. Although according to the above-described, there is used the method of filling ink by controlling the back pressure for the respective line, since an amount of consuming ink for the one line is very small, it may be set that operation is carried out at every plural lines to a degree of not producing nonuniformity of printing.

The above-described is the operation of recording one line and by successively repeating the operation, a desired image is outputted onto the record paper 30.

Further, the meniscus state can stably be maintained always in an optimum state even by such a simple back pressure adjusting mechanism and accordingly, high quality image without nonuniformity of printing can stably be outputted.

As has been explained, according to the ink jet recording head and the image recording apparatus using the recording head of the invention, the front end of the member in the plate-like shape forming the opening portion in the slit-like shape, is formed by the wedge shape projected to the record medium and the inclined face portion in the wedge shape is subjected to the water repellant and oil repellant processing.

Further, at least one location or more of the ink discharging means for discharging extra ink is provided at the portion outside of the printing area of the end face portion of the base plate constituting the opening portion. There is constructed the constitution in which by providing the ink discharging means with the notched groove having the size sufficiently larger than the inner width in the short direction of the opening portion at the end face of the base plate in the discharge position, extra ink leaks out to the surface of the base plate via the portion of the notched groove.

Therefore, the amount of the meniscus at the front end portion of the head can be adjusted to a predetermined amount, the ink can be jetted stably and there is achieved an effect of stabilization of printed dots and stabilization of continuous printing.

Further, there is constructed the constitution in which when excessive back pressure is applied to ink, ink flows to the portion of the notched groove having low flow path resistance and extra ink is escaped to the side of the ink recovering means.

By such a constitution, there is constructed the structure in which even when the meniscus collapse, overflowed ink is difficult to effect influence on the image quality and there is achieved an effect of promoting stability of printing.

Further, in addition to the above-described constitution of the ink jet recording head, there is constructed the constitution having the detecting means for detecting the state in which extra ink leaks out at the inclined face portion or the portion of the notched groove and the back pressure controlling means for properly adjusting the back pressure of the ink jet recording head in the ink supply means by the detecting means.

By constructing such a constitution, according to the ink jet recording head, the shape of the meniscus of ink can always be maintained in the constant and proper state by the back pressure control mechanism having the simple constitution, as a result, the apparatus can realize an image output which is not provided with nonuniformity of printing, and is stable and provided with high quality, at low cost and easily.

What is claimed is:

1. A recording head for an electrostatic type ink jet system which draws in and ejects ink by exerting a Coulombic force, the recording head comprising:

upper and lower base plates opposed to each other and spaced by a gap defining an opening portion at end faces of the base plates, the opening portion having a slit-like shape;

a plurality of recording electrodes arranged on an inner face of at least one of the base plates and having front ends proximate the opening portion;

an ink supply mechanism in liquid communication with the opening portion via the gap between the two base plates for supplying ink;

an opposed electrode spaced apart from the opening portion by a given distance so that a recording medium may be passed between the opening portion and the opposed electrode;

driving means for applying voltage pulses between the record electrodes and the opposed electrode; and means for maintaining a constant ink meniscus at the opening portion.

2. A recording head according to claim 1; wherein the means for maintaining a constant ink meniscus comprises inclined surfaces of the upper and lower base plates defining a wedge shape to provide the base plates with sharpened front portions facing the opposed electrode, the inclined surfaces having an angle of inclination set so that a critical surface tension at the respective inclined surfaces of the upper and the lower base plates is smaller than a surface tension of the ink.

3. A recording head according to claim 2; wherein the inclined surface of at least one of the upper and lower base plates is subjected to an oil repellant processing when the ink is an oil-based ink and to a water repellant processing when the ink is an aqueous-based ink.

4. A recording head according to claim 3; wherein an outer surface of at least one of the base plates in contact with the inclined surface thereof and rearward of the inclined surface relative to the recording medium is subjected to hydrophilic processing when the ink is an aqueous-based ink and lipophilic processing when the ink is an oil-based ink.

5. A recording head according to claim 2; wherein the shape of the wedge is formed by subjecting a front end portion of each of the base plates to etching.

6. A recording head according to claim 2; wherein an angle defined by the inclined surfaces of the respective base plates at a front end of the sharpened front portion is equal to or smaller than 20 degrees.

7. A recording head according to claim 2; further comprising an ink recovery mechanism for recovering excess ink leaking out beyond the wedge shape defined by the inclined surfaces of the base plates.

8. A recording head according to claim 7; wherein a path between the inclined surfaces and the ink recovery mechanism is subjected to one of a water repellant or an oil repellant processing.

9. A recording head according to claim 7; wherein the ink recovery mechanism comprises at least one of a groove, a tank, a tray, and an absorbing member provided on at least one of the base plates.

10. A recording head according to claim 2; further comprising an ink discharge mechanism provided at an end portion of at least one of the base plates for discharging excess ink outside of a printing area defined by the opening portion.

11. A recording head according to claim 10; further comprising detecting means for detecting excess ink leaking beyond the wedge shape; and back pressure controlling means for adjusting a back pressure of the ink by controlling the ink supply mechanism in accordance with an output of the detecting means.

12. A recording head according to claim 1; further comprising an ink discharge mechanism provided at an end portion of at least one of the base plates for discharging excess ink outside of a printing area defined by the opening portion and maintaining the size of the meniscus constant.

13. A recording head according to claim 12; wherein the ink discharge mechanism comprises a notched groove formed in an outside surface of at least one of the base plates and having a width larger than an inner width in a short direction of the opening portion.

14. A recording head according to claim 12; further comprising an ink recovery mechanism for recovering ink which has leaked from the ink discharge mechanism.

15. A recording head according to claim 14; wherein the ink recovery mechanism comprises at least one of a groove, a tank, a tray and an absorbing member provided on at least one of the base plates.

16. A recording head according to claim 14; wherein a path between the ink discharge mechanism and the ink recovery mechanism is subjected to a water repellant or an oil repellant processing.

17. A recording head according to claim 12; further comprising detecting means for detecting excess ink leaking out of the opening portion; and back pressure controlling means for adjusting a back pressure of the ink by controlling the ink supply mechanism in accordance with an output of the detecting means.

18. An image recording apparatus comprising: a recording head according to claim 1; a recording medium arranged between the opening portion of the recording head and the opposed electrode; and a transfer mechanism for scanning the recording medium in synchronism with operation of the recording head so that a desired image is formed on the recording medium by controlling the recording head and the transfer mechanism.

19. An image recording apparatus for forming a color image on a recorded medium, comprising: a plurality of independently controlled recording heads; an ink supply portion for supplying ink having different colors independently from each other to the respective recording heads; and a transfer mechanism for scanning the recorded medium in synchronism with driving the recording heads.

20. An ink jet recording head comprising: a support body having an ink chamber in liquid communication with an ink reservoir and having an opening portion in a front surface in liquid communication with the ink chamber; an ink supply mechanism for supplying ink from the ink reservoir to the ink chamber and the opening portion such that an ink meniscus is formed at the opening portion and comes in contact with the front surface of the support body proximate the opening portion; a plurality of recording electrodes provided on the support body proximate the opening portion; an opposed electrode spaced apart from the opening portion by a given distance so that a recording medium may be passed between the support body and the counter electrode; a power supply circuit for supplying voltages to the plurality of recording electrodes and the opposed electrode; and meniscus size controlling means for maintaining the size of the ink meniscus constant.

21. An ink jet recording head according to claim 20; wherein the meniscus size controlling means comprises a predetermined shape of front surface of the support body proximate the opening portion for restricting the size of the meniscus.

22. An ink jet recording head according to claim 21; wherein the predetermined shape of the front surface of the support body proximate the opening portion is a wedge-like shape which has a sharpened end portion thereof confronting the opposed electrode.

23. An ink jet recording head according to claim 20; wherein meniscus size controlling means comprises a surface layer provided on the front surface of the support body to control the size of the meniscus proximate the opening portion.

24. An ink jet recording head according to claim 23; wherein the surface layer comprises one of an oil repellant material and a water repellant material.

25. An ink jet recording head according to claim 20; wherein an ink meniscus is formed proximate each of the plurality of electrodes; and the meniscus size controlling means comprises means for maintaining a constant size of the meniscuses formed at each of the respective recording electrodes.

26. An ink jet recording head according to claim 20; further comprising an ink recovery mechanism for recovering excess ink leaking out of the opening portion.

27. An ink jet recording head according to claim 26; wherein the ink recovery mechanism comprises at least one of a groove, a tank, a tray and an absorbing member provided on the support body.

28. An ink jet recording head according to claim 20; further comprising an ink discharge mechanism provided at a lateral end of the opening portion for discharging excess ink outside of a printing area defined by the opening portion.

29. An ink jet recording head according to claim 20; further comprising detecting means for detecting excess ink leaking outside the opening portion; and back pressure controlling means for adjusting a back pressure of the ink by controlling the ink supply mechanism in accordance with an output of the detecting means.

* * * * *